US007467496B1

(12) United States Patent
Cuisset et al.

(10) Patent No.: US 7,467,496 B1
(45) Date of Patent: Dec. 23, 2008

(54) METHOD FOR JOINING COMPONENTS OF INFLATABLE STRUCTURES

(75) Inventors: Bruno Cuisset, Neptune City, NJ (US); Frank J. Brown, Bayville, NJ (US); Alexandre Targiroff, Howell, NJ (US); Stanley J. Pawlowski, Jr., South River, NJ (US)

(73) Assignee: Air Cruisers Company, Wall, NJ (US)

( * ) Notice: Subject to any disclaimer, the term of this patent is extended or adjusted under 35 U.S.C. 154(b) by 819 days.

(21) Appl. No.: 10/862,244

(22) Filed: Jun. 7, 2004

(51) Int. Cl.
*E04B 1/00* (2006.01)

(52) U.S. Cl. ..... 52/2.18; 52/2.22; 52/2.23; 52/2.24

(58) Field of Classification Search ..... 52/2.11, 52/2.18, 2.19, 2.22, 2.23, 2.24; 428/57; 403/5; 156/227
See application file for complete search history.

(56) References Cited

U.S. PATENT DOCUMENTS 3,910,532 A 10/1975 Fischer
3,995,339 A * 12/1976 Kaufman ..... 441/40
4,156,330 A * 5/1979 Fraioli ..... 52/2.25
5,806,572 A 9/1998 Voller
5,871,180 A 2/1999 Hublikar
5,875,868 A 3/1999 Smialowicz et al.
5,975,467 A 11/1999 O'Donnell et al.
5,988,438 A 11/1999 Lewis et al.
6,199,676 B1 3/2001 Targiroff
6,298,970 B1 10/2001 Targiroff
6,581,334 B2 * 6/2003 Oney et al. ..... 52/2.18
6,641,445 B1 11/2003 Jurlina et al.
6,644,596 B1 11/2003 Jurlina et al.

* cited by examiner

*Primary Examiner*—Richard E Chilcot, Jr.
*Assistant Examiner*—Matthew J Smith
(74) *Attorney, Agent, or Firm*—Lawrence G. Fridman

(57) ABSTRACT

A flexible connection joint for inflatable structures such as life rafts, evacuation slides, and the like, includes a flexible connection member to join walls of the inflatable structure together. The flexible connection member includes first and second strip portions that are bonded together at one end to from three legs that can be joined to two or three walls of the structure or to other connecting elements or strips. In this manner, a tensile force acting on at least one of the walls of the structure causes generation of shear forces between the flexible legs and walls to thereby resist their separation.

5 Claims, 6 Drawing Sheets

METHOD FOR JOINING COMPONENTS OF INFLATABLE STRUCTURES

BACKGROUND OF THE INVENTION

1. Field of the Invention

This invention relates to connecting elements more particularly to a connector for securing components of inflatable structures or membranes together.

2. Discussion of the Prior Art

It is known in the prior art to construct inflatable members or components that are impervious to air and water. In order to form useful inflatable structures, such as life rafts and evacuation devices for commercial and military aircraft, two or more inflatable members, as well as non-inflatable members such as floors and support webs, are typically joined together.

An example of a prior art arrangement for joining inflatable members together is illustrated in FIG. 1. An inflatable structure 10 of a prior art floatation device, such as a life raft, is schematically shown in cross section. The inflatable portion 10 includes a lower inflatable tubular member 12 and an upper inflatable tubular member 14 that is joined to the lower tubular member at a connection joint 16. Each tubular member 12, 14 includes a wall 18 that is impervious to air and water. The connection joint 16 has an area of adhesive 20 between the tubular members and a crotch tape 22 located on opposite sides of the tubular members. The adhesive bonds the tubular members 12, 14 together and bonds the crotch tapes 22 to the walls 18 of the tubular members. Each crotch tape 22 can be constructed as a single piece of material which is bent to form a V-shape member. The crotch tapes 22 serve to enclose the adhesive area 20 and prevent separation of the tubular members 12, 14.

Although this type of structure is currently in use, it has been found that the connection joint is prone to leakage, especially at the ends of the inflatable structures where overlapping joints are common. Thus, when the inflatable portion 10 is part of a life raft, sea water can leak into the connection joint 16 and compromise the integrity of the structure.

In addition, as shown in FIG. 2, the prior art connection joint 16 is subject to a peeling mode of failure, which tends to separate or dismember the joint, and thus the inflatable elements and/or panels connected at the joint. The peeling mode occurs, for example, when a tensile force is applied to the leg 24 generally in the direction of the arrow 28. When this force is applied, the leg 26 will tend to separate from the wall 18. The same peeling mode exists in structures where a panel, such as a floor panel of a raft, is directly bonded to an inflatable member or other panel. For a used fabric utilized in the filed of inflatable structures, it has been found that the panels or walls tend to peel apart with an applied force of approximately 7 pounds per square inch (psi).

The above-described problems are further augmented by the long curing time of adhesives used to bind the panels together. The formation of each connection joint is labor intensive and requires the application of a suitable layer of adhesive between overlapping areas of the walls, tape and/or panels. Each joint must be formed separately and typically must be cured for at least four hours before forming a subsequent joint. Thus, much manufacturing time is lost due to the long curing process and human error can be a substantial factor since much of the bonding technique requires human intervention. Other prior art connecting joints are illustrated in FIGS. 12 and 15 and will be discussed in full detail later in the application.

BRIEF SUMMARY OF THE INVENTION

According to one aspect of the invention, a flexible connection member for joining at least two flexible walls together includes a first flexible leg adapted for connection to a first flexible wall, a second flexible leg extending from the first flexible leg, with the second flexible leg being adapted for connection to one of the first and a second flexible wall, and a third flexible leg extending from the first and second flexible legs to thereby form a generally Y-shaped or T-shaped connection member. The third flexible leg is adapted for connection to the other of the first and second flexible walls or to a further flexible wall. With this arrangement, a tensile force acting on at least one of the legs causes a shear force between the remaining legs and the walls when connected together to thereby resist separation of the legs and walls.

According to a further aspect of the invention, a flexible connection joint comprises a first flexible wall, a second flexible wall, and a flexible connection member extending between the first and second flexible walls to thereby join the walls together. The flexible connection member includes a first flexible leg connected to the first flexible wall, a second flexible leg extending from the first flexible leg with the second flexible leg being connected to one of the first and second flexible walls, and a third flexible leg extending from the first and second flexible legs. The third flexible leg is connected to the other of the first and second flexible walls or to a further flexible wall. In this manner, a tensile force acting on at least one of the walls causes a shear force between the flexible legs and walls to thereby resist separation of the legs and walls.

According to yet a further aspect of the invention, an inflatable structure comprises a first flexible member having a first wall, a second flexible member having a second wall, with at least one of the first and second flexible members being inflatable, and a first flexible connection member extending between the first and second walls to thereby join the walls together. The first flexible connection member comprises a first flexible leg joined to the first wall, a second flexible leg extending from the first leg and being joined to the first wall, and a third flexible leg extending from the first and second flexible legs and being joined to the second wall. With this arrangement, a tensile force acting on at least one of the walls causes a shear force between the flexible legs and walls to thereby resist separation of the legs and walls.

According to an even further aspect of the invention, a method of forming a flexible connection member for joining at least two flexible walls together comprises providing first and second flexible strip portions, positioning one strip portion over the other strip portion, and joining one end section of the first and second flexible strip portions together to thereby form a first flexible leg with second and third flexible legs extending from the first flexible leg.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

It is noted that the drawings are intended to depict only typical embodiments of the invention and therefore should not be considered as limiting the scope thereof. It is further noted that the drawings are not necessarily to scale. The invention will now be described in greater detail with reference to the accompanying drawings.

DETAILED DESCRIPTION OF THE INVENTION

Figure 3:
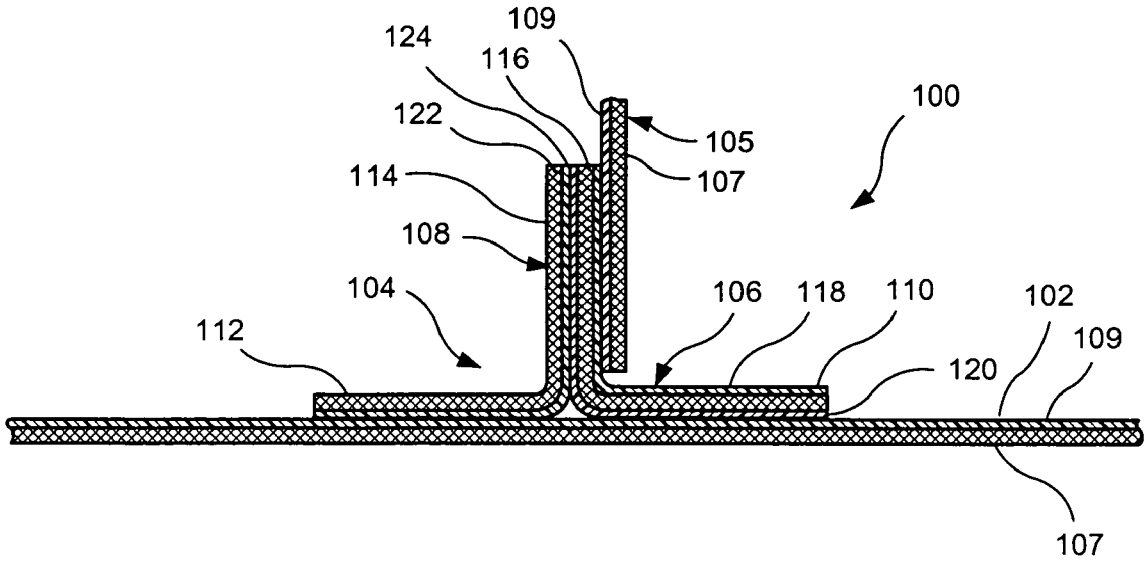
FIG. 3 is a sectional view of a connection joint in accordance with the present invention.

Referring to the drawings, and to FIG. 3 in particular, a connection joint 100 in accordance with the present invention is illustrated. The connection joint 100 may form part of a larger structure, such as a floatation device, escape slide, or other inflatable and/or non-inflatable structure where it is desirable to join flexible walls, panels or membranes together. The connection joint 100 thus includes a first flexible wall 102 and a second flexible wall 105 of a structure and a flexible connection member 104 joining the walls 102, 105 together. It is understood that the term "wall" as used throughout the specification can refer to a panel, connection strip or tape, barrier, reinforcing member, support web, membrane or the like.

In the filed of inflatable structures, the walls 102 and 105 are preferably constructed of a fabric that is strong, flexible, light weight, puncture-resistant, abrasion-resistant, and impervious to air and water. By way of example, a suitable fabric can include a core 107 constructed of a woven nylon material or the like and a layer 109 of bonding polyurethane or other fusible elastomeric material applied to at least one side of the core 107. This type of fabric is especially advantageous for inflatable members and non-inflatable support panels, such as floors of rafts, due to its enhanced air tightness when inflated, strength, and overall weight reduction of the final product. Although not shown, a layer of bonding, fusible or elastomeric material may also be applied to an opposite side of the core 107. It will be understood, of course, that other materials and/or coatings can be used for the walls 102, 105.

The connection member 104 includes a first flexible strip portion 106 and a second flexible strip portion 108 that are joined together to form a generally Y-shaped or T-shaped member with a first flexible leg 110, a second flexible leg 112, and a third flexible leg 114. The third leg 114 extends from the first and second legs 110, 112. Preferably, the first, second and third flexible legs are of equal length. As shown, the first and second legs are connected to the wall 102 while the third leg is connected to the wall 105. It will be understood that each leg 110, 112 can be connected to separate walls to thereby join three walls together at the connection joint 100.

In the preferred embodiment of the invention, the first strip portion 106 includes a core 116, an outer layer 118 on one side of the core, and an inner layer 120 on an opposite side of the core. In a similar fashion, the second strip portion 108 includes a core 122 and an inner layer 124 on a side of the core 122 that faces the inner layer 120 of the first strip portion 106. Although not shown, in other embodiments of the invention, a layer of bonding, fusible or elastomeric material may also be applied to an opposite side of the core 122 of the second strip portion 108. Alternatively, the first strip portion 106 may have only an inner layer 120. Preferably, the core and layers are constructed of materials that are compatible with the walls of the structure to which the connection member 104 is to be attached. Thus, when the walls 102, 105 are constructed of a woven material with an elastomeric coating, the strip portions 106, 108 are preferably formed of the same material and coating. It will be understood that the width and length of the strip portions, as well as the weight of the fabric and thickness of each layer may greatly vary depending on the particular application of the connection member 104. Although the connection joint of the invention will be described composed of woven material with layers of elastomeric coating, it should be understood that any material compatible with the fabric of the core and having bonding qualities or capable of being fused, bonded or solidified after being melted can be utilized as inner and outer layers of the strip portions.

In one embodiment of the invention, the first and second strip portions 106, 108 are preferably joined together through a thermobonding process to form the third leg 114, as will be described in greater detail below with respect to FIGS. 6-10. The walls 102, 104 are also preferably joined to the legs 110, 112 and 114 through thermobonding to thereby form a unitary structure.

Figure 4:
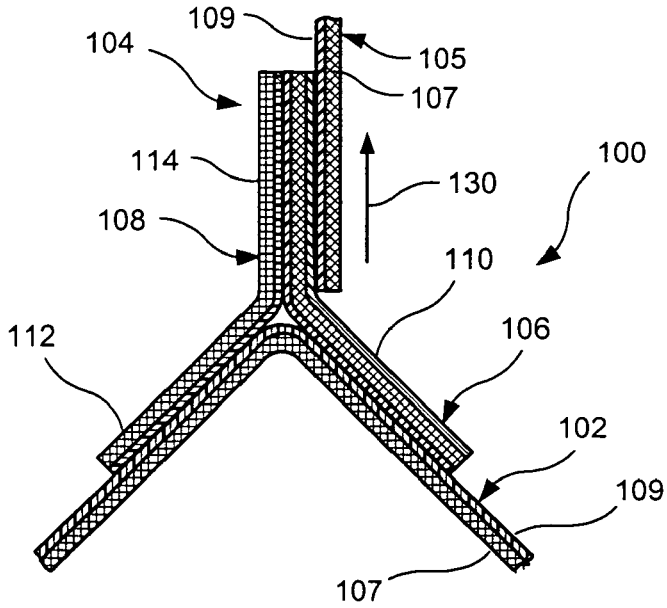
FIG. 4 is a sectional view similar to FIG. 3 illustrating forces applied to the connection joint.

With additional reference to FIG. 4, when a tensile force is applied to the leg 114 generally in the direction of arrow 130, the legs 110, 112 of the connection member 104 will tend to deform the wall 102, which in turn creates a first shear force between the leg 110 and the wall 102, a second shear force between the leg 112 and the wall 102, and a third shear force between the leg 114 and the wall 105. An important feature of the invention is that the beneficial shear forces between the legs of the connection member and connected walls will be developed when a tensile force is applied to one or any combination of the legs 110, 112 and 114 and/or their connected walls in virtually any direction.

Figure 5:
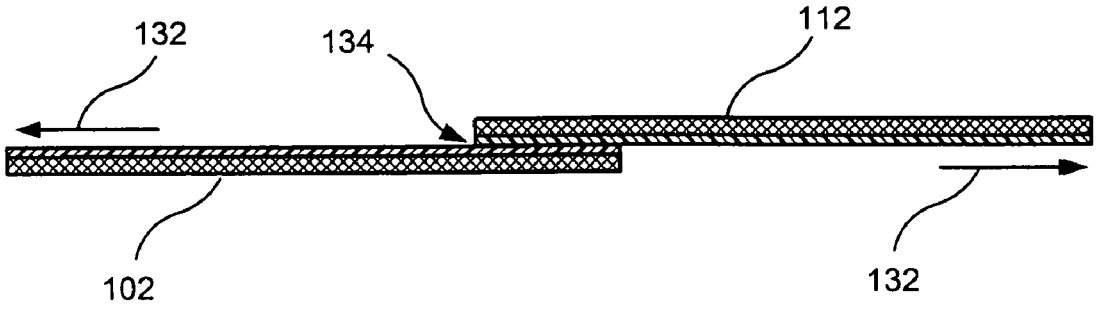
FIG. 5 is a sectional view of a portion of the connection joint of FIG. 4 showing a sheer mode of operation.

FIG. 5 is a representative enlarged view of one of the legs 112 of the connection member and the wall 102 in the beneficial shear condition. It is being understood that the other legs 110 and 114 and the walls to which they are joined will be under similar shear conditions. It should be noted however that although the actual shear forces may vary depending on the amount and direction of the applied tensile force. When a tensile force is applied to one of the legs and/or the walls attached to the legs, substantially equal but opposite by directed shear forces 132 will be present at the joint where the leg 112 and wall 102 are attached. With the shear forces 132 acting in the same plane as the wall 102, the tensile strength of the material is advantageously utilized in the invention to greatly increase the strength of the connection joint 100. When the cores of the wall and tension member are constructed of a woven nylon material, the tensile strength of such material used in the invention is approximately 250 psi. Obviously, this is substantially greater than the 7 psi amount of the peeling apart barrier.

One of the essential features of the invention is that the provision of a connection member 104 with a generally Y-shaped or T-shaped configuration redirects forces from the prior art peeling mode of failure (FIG. 2) to a more durable sheer mode of operation. Under test conditions, it has been found that the integrity of the connection joint 100 has been maintained when exposed to pressures of over 10 psi, which is much greater than the prior art connection joint 16 described above.

Figure 6:
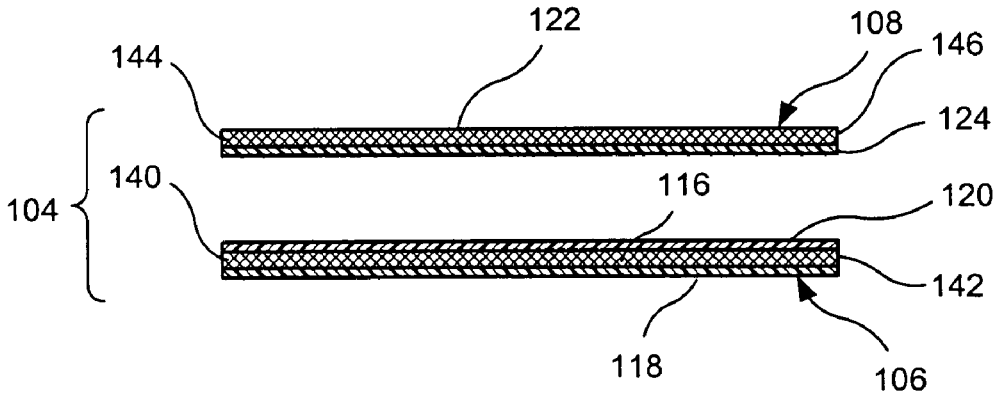
FIG. 6 is a sectional exploded view of a connection member that forms part of the connection joint of FIG. 3 and showing a first step for forming the connection member in accordance with the present invention.
Figure 7:
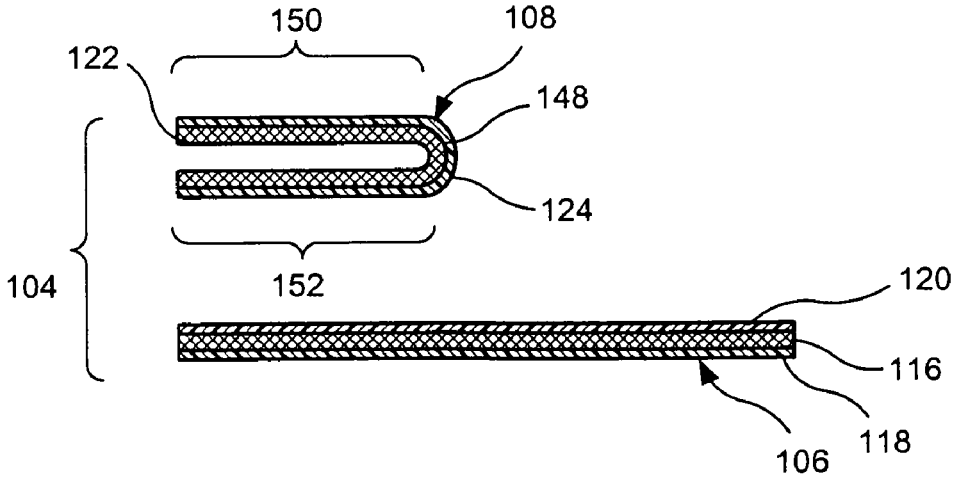
FIG. 7 is a sectional exploded view similar to FIG. 6 showing a second step for forming the connection member.

With reference now to FIGS. 6 to 10, a method of constructing the connection member 104 is illustrated. As shown in FIG. 6, the second strip portion 108 is positioned over the first strip portion 106. The first and second strip portions 106, 108 are preferably of equal width, so that the edges 140 and 142 of the first strip portion 106 are aligned with the edges 144 and 146, respectively, of the second strip portion 108. Once aligned, the second strip portion 108 is folded in half to form a bend or crease 148, as shown in FIG. 7, such that an inner section 152 of the inner layer 124 of the second strip portion 108 faces a corresponding section of the inner layer 120 of the first strip portion 106 and an outer section 150 of the second strip portion faces away form the inner layer 120.

Figure 8:
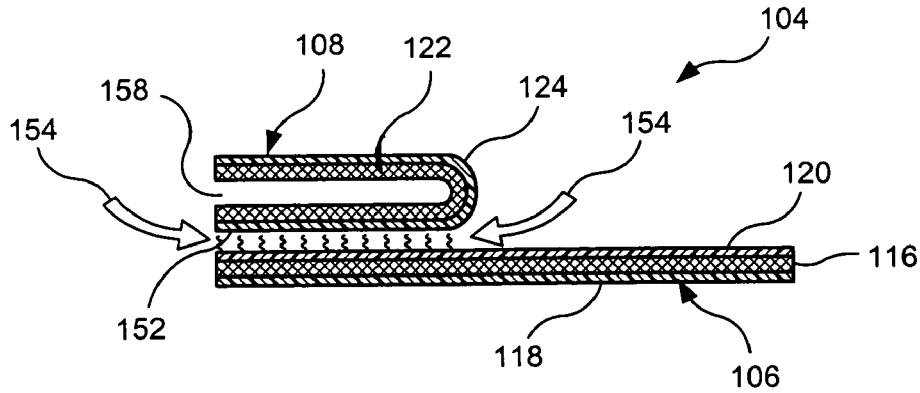
FIG. 8 is a view similar to FIG. 6 showing a third step for forming the connection member.
Figure 9:
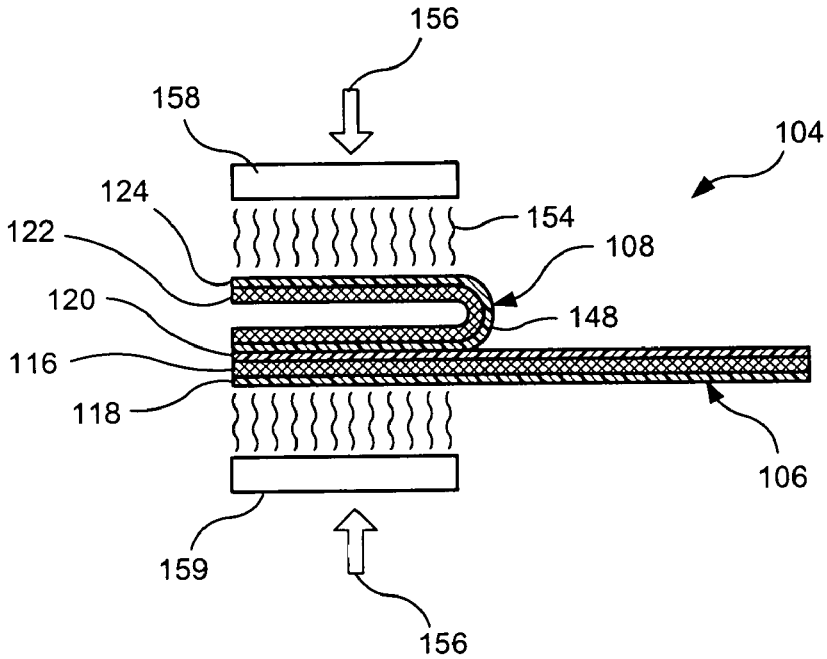
FIG. 9 is an assembled sectional view of the connection member showing a fourth forming step.

As shown in FIGS. 8 and 9, the inner section 152 of the second strip portion 108 and the corresponding section of the first strip portion 106 are joined together during a thermobonding process. As shown in FIG. 9, the thermobonding process includes applying heat schematically illustrated by the wave lines 154 and pressure illustrated by the arrows 156 to the first and second strip portions 106, 108 to join the strip portions together. Preferably, the heat and pressure are applied by feeding the first and second strip portions between an upper feed roller 158 and a lower feed roller 159. The rollers are preferably in direct contact with the first and second strip portions to apply pressure thereto. However, intermediate members (not shown), such as release substrates, films, walls, or other structure may be positioned between the rollers and the first and second strip portions. Preferably, a heat source (not shown) blows a heating fluid 154, such as heated air, onto the first and second strip portions. The combined pressure and heat softens or melts the inner layers 120, 124 and fuses them together upon such layers being solidified. In the instance when the inner layers are constructed of a urethane material, the applied temperature is approximately 500 degrees Fahrenheit.

More details of the thermoforming method can be found in U.S. Pat. No. 6,199,676 to Targiroff, the disclosure of which is hereby incorporated by reference. The first and second strip portions 106, 108 are preferably fed linearly through the rollers 158, 159 during the thermobonding process. When the second strip portion 108 includes both an inner and outer layer, a release film or other substrate (not shown) may be positioned in the space 158 (FIG. 8) to prevent the second strip member from fusing to itself.

Figure 10:
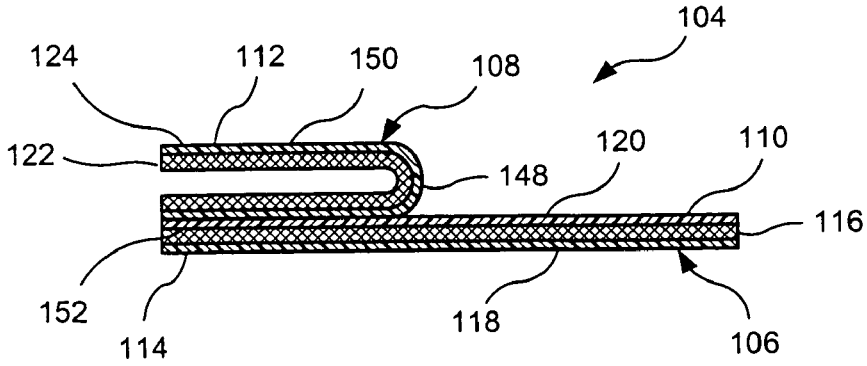
FIG. 10 is a sectional view of the completed connection member of the invention.

Once the thermobonding process has completed, the connection member 104, as shown in FIG. 10, is formed including: a) the first leg 110 comprising the remaining non-fused section of the first strip portion 106; b) the second leg 112 comprising the section 150 of the second strip portion 108; and c) the third leg 114 comprising the section 152 of the second strip portion 108 and the corresponding fused section of the first strip portion 106. The non-fused sections of layers 118, 120, and 124 can now be fused or otherwise connected to walls or panels of inflatable and/or non-inflatable structures, as previously described with respect to FIGS. 3 and 4, and as will be further described with respect to FIGS. 11, 13 and 14. Preferably, the walls or panels have at least one fusible layer that can be thermally bonded or otherwise permanently connected to one or more fusible layers of the legs 110, 112 and 114 to form the desired structure. Although it is convenient to form the connection member before connecting the walls or panels of a structure together, it is understood that the walls or panels can be also simultaneously connected or fused to the legs during formation of the connection member 104.

Instead of a forced air heating arrangement, the strip and tapes may be heated to the desired thermobonding temperature by thermal feed rollers. Alternatively, the thermobonding method can include RF heat sealing or the like.

Figure 11:
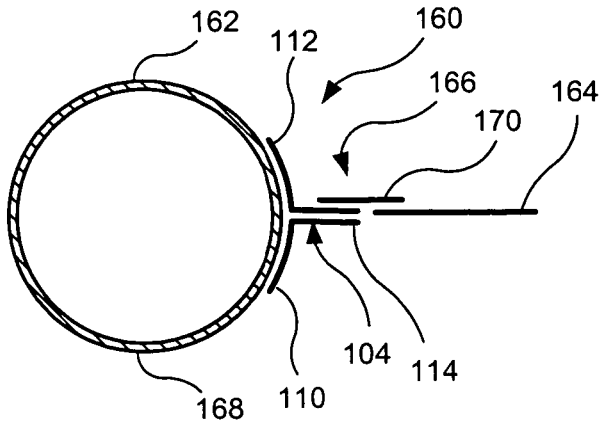
FIG. 11 is a schematic sectional view of an inflatable structure utilizing the connection member in accordance with the invention.

Referring now to FIG. 11, an inflatable structure 160 in accordance with a further embodiment of the present invention is schematically shown in cross section. The inflatable structure 160 may form part of a life raft, swimming pool, evacuation slide, and so on, and includes an inflatable tubular member 162 and a panel 164 that is joined to the tubular member 162 at a connection joint 166 (shown in exploded view). The panel 164 may form part of a floor, wall, or the like of the inflatable structure. The tubular member 162 includes a wall 168 that is impervious to air and water. The panel 164 may also be impervious to air and water, depending on the particular structure being formed.

The connection joint 166 includes a connection member 104 joined to the wall 168 and a connection strip 170 extending between the connection member 104 and the panel 164. The connection strip 170 is preferably formed of the same material as the first and second strip portions of the connection member 104. Preferably, the legs 110, 112 of the connection member 104 are thermally fused to the wall 168 of the tubular member 162 while the leg 114 is thermally fused to the connection strip 170. The connection strip 170 is then bonded or thermally fused to the panel 164. Although the provision of a connection strip 170 between the connection member 104 and the panel 164 is preferred, it is understood that the connection strip may be eliminated and the panel 164 be directly joined to the connection member 104.

With this construction, any tensile forces acting on the panel 164 will be resisted by shear forces acting between the legs 110, 112 of the connection member 104 and the tubular member as previously described with respect to FIGS. 4 and 5, as well as shear forces acting between the leg 114 and the connection strip 104, and shear forces acting between the connection strip 104 and the panel 164.

Figure 12:
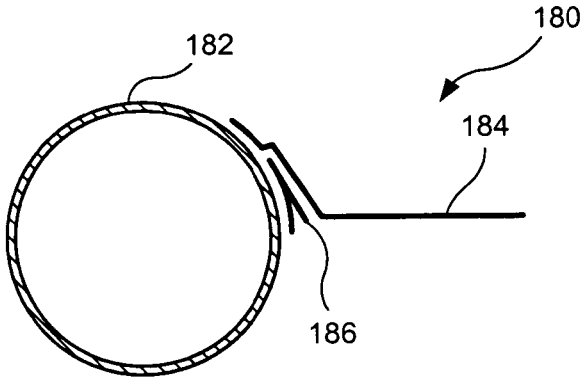
F I G. 12 PRIOR ART
FIG. 12 is a schematic sectional view of a prior art inflatable structure.

The inflatable structure 160 constructed in the above-described manner is advantageous over the peel mode of failure of a corresponding prior art inflatable structure 180 shown in the exploded view of FIG. 12. The prior art inflatable structure 180 includes an inflatable tubular member 182 and a panel 184 that is directly bonded to the tubular member by adhesives or the like. A crotch tape 186 is also adhesively bonded to the tubular member 182 and the panel 184 to enclose the adhesive area and prevent separation of the tubular member and panel. As discussed hereinabove with respect to FIGS. 1 and 2, any tensile forces acting on the panel 184 will tend to pull the panel from the tubular member under the peel mode of failure.

Figure 13:
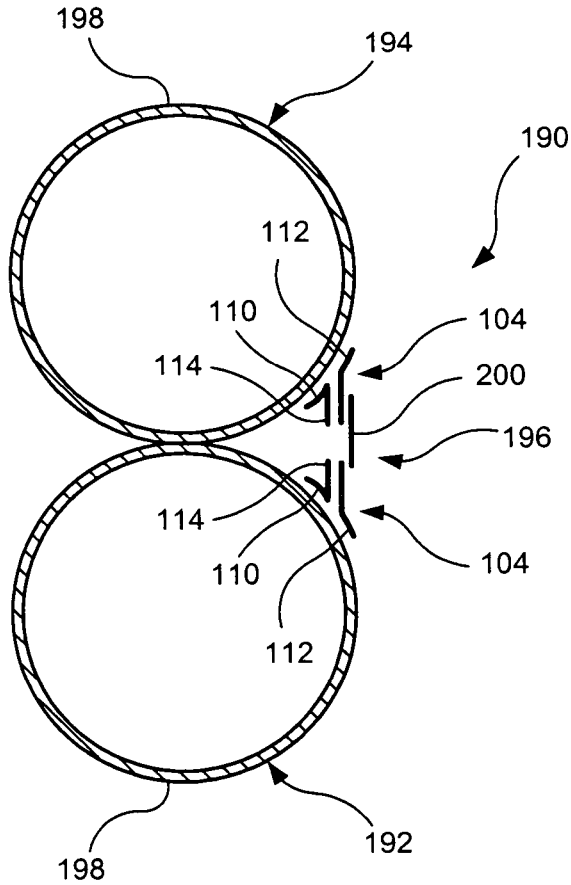
FIG. 13 is a schematic sectional view of an inflatable structure in accordance with further embodiment of the invention.

Referring now to FIG. 13, an inflatable structure 190 in accordance with a further embodiment of the present invention is schematically shown in cross section. The inflatable structure 190 may form part of a life raft, swimming pool, evacuation slide, and so on, and includes a lower inflatable tubular member 192 and an upper inflatable tubular member 194 that is joined to the lower tubular member at a connection joint 196 (shown in exploded view). Each of the tubular members 192, 194 has a wall 198 that is impervious to air and water.

The connection joint 196 includes a pair of connection members 104 that are joined to the walls 198 and a connection strip 200 extending between the connection members 104. As in the previous embodiment, the connection strip 200 is preferably formed of the same material as the first and second strip portions of the connection members 104. Preferably, the legs 110, 112 of the connection members 104 are thermally fused or otherwise permanently connected to their respective walls 198, while the legs 114 are thermally or permanently fused to the connection strip 200. During construction of the inflatable structure 190, the connection members 104 can be preferably pre-attached to the connection strip 200 to form a membrane that is then attached to the walls of the tubular members during a secondary operation. Although the provision of a connection strip 200 between the connection members 104 has been described, it is understood that the connection strip may be eliminated and the connection members be directly joined together. Although not shown, a second connection joint 196 may be located on an opposite side of the inflatable tubular members 192, 194.

With the above-described construction, any tensile forces acting on the inflatable structure 190 that would tend to separate the tubular members will be resisted by shear forces acting between the legs 110, 112 of the connection members 104 and the tubular members as previously described with respect to FIGS. 4 and 5, as well as shear forces acting between the legs 114 and the connection strip 200.

Figure 1:
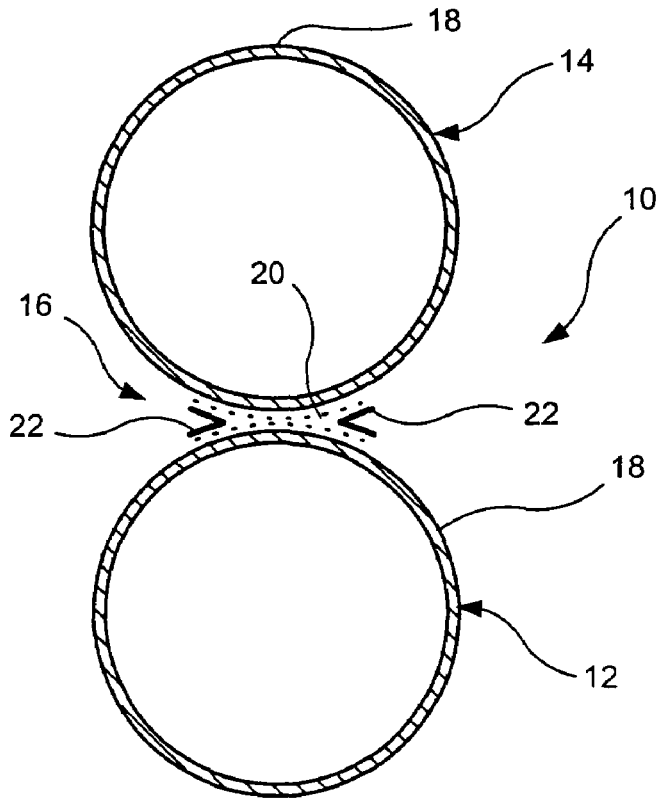
F I G. 1 PRIOR ART
FIG. 1 is a schematic sectional view of a prior art inflatable structure.
Figure 2:
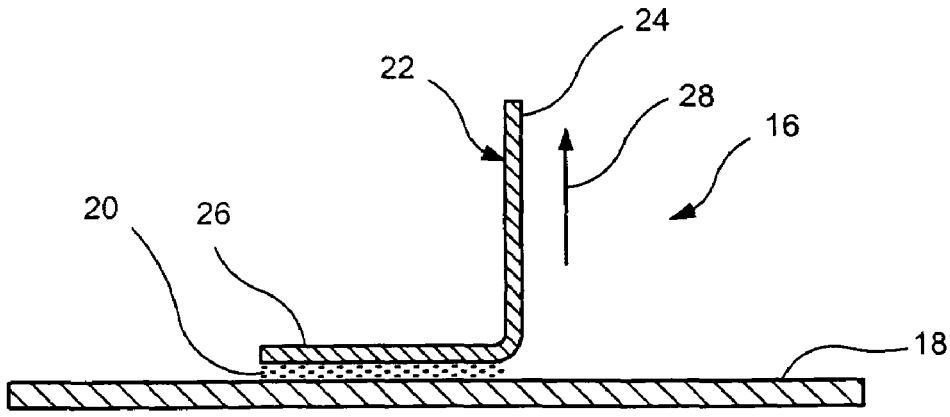
F I G. 2 PRIOR ART
FIG. 2 is a schematic sectional view of a prior art connection joint for an inflatable structure showing a peel mode of failure.

The inflatable structure 190 constructed in the above-described manner is advantageous over the peel mode of failure of a corresponding prior art inflatable structure 10 as shown in FIGS. 1 and 2, and as discussed hereinabove. In addition, the inflatable structure 190 can be beneficiary formed by a continuous and automatic manufacturing process to thereby reduce manufacturing costs and eliminate human error that is more prevalent in the prior art. With the provision of the connection members 104, the tubes can be continuously bonded together all around their perimeter to thereby eliminate overlapping seams or joints. Accordingly, greater fluid holding integrity over the prior art is achieved, especially when constructed as a raft, since there are virtually no overlapping joints through which sea water can enter.

Figure 14:
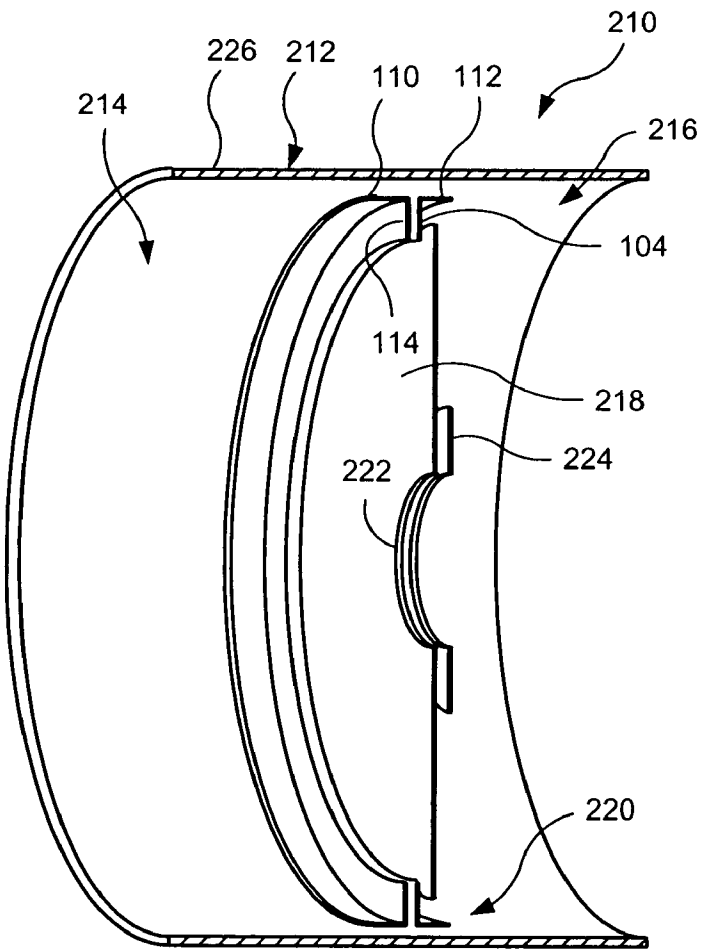
FIG. 14 is a sectional view of an inflatable structure in accordance with yet another embodiment of the invention.

With reference now to FIG. 14, an inflatable structure 210 in accordance with a further embodiment of the present invention is schematically shown in cross section. The inflatable structure 210 is in the form of a bulkhead assembly and includes a tubular member 212 that is divided into a first compartment 214 and a second compartment 216 by a circular membrane or bulkhead panel 218 that is joined to the tubular member at a connection joint 220 (shown in the exploded view). The bulkhead panel 218 may have a central opening 222 and a reinforcing ring 224 surrounding the opening. The tubular member 212 preferably includes a wall 226 that is impervious to air and water.

The connection joint 220 includes the connection member 104 joined to the wall 226 and the bulkhead panel 218. Preferably, the legs 110, 112 of the connection member 104 are thermally fused to the wall 226 while the leg 114 is thermally fused to the outer periphery of the bulkhead panel 218.

During assembly of the inflatable structure 210, the connection member 104 is preferably joined to the wall 226 of the tubular member 212 while it is still flat and before it has been formed in a tubular shape. After transformation of the wall 226 into the tubular member 212, the bulkhead panel 218 is joined to the connection member 104 in a continuous operation around its periphery.

Figure 15:
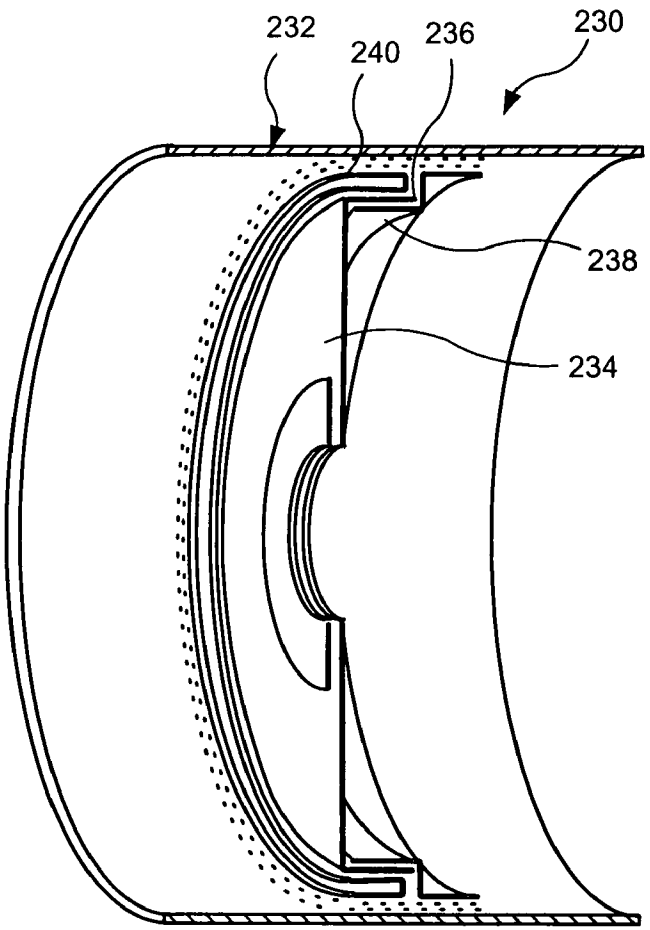
FIG. 15 PRIOR ART
FIG. 15 is a sectional view of a prior art inflatable structure.

The inflatable structure 210 constructed in this manner requires less material, is easier to manufacture, and is more cost effective than the prior art solution as illustrated in FIG. 15. In addition, the structure 210 provides air holding integrity and places the connection joint 220 in a sheer mode of operation when the bulkhead panel 218 flexes in opposite directions due to fluctuations in air pressure within the tubular member 212.

Referring now to FIG. 15, a prior art bulkhead assembly 230 includes a tubular member 232 and a bulkhead panel 234 that is adhesively secured to the tubular member. An outer periphery of the bulkhead panel is gusseted or slit at spaced circumferential locations and then cemented together to form a flange section 236 that faces the tubular member 232. An inside collar 238 is cemented on one side of the flange section while a crotch tape 240 is cemented on the opposite side. The assembly is then cemented to the tubular member 232. The crotch tape and inside collar function to maintain the air holding integrity of the structure and prevent separation of the bulkhead panel from the tubular member through the peeling mode of failure as discussed above with respect to FIGS. 1 and 2. With this prior art arrangement, it can be seen that a number of labor intensive manual forming and bonding steps, as well as a greater number of parts, are required to construct the prior art bulkhead assembly 230. Such arrangement leads to greater manufacturing costs and human errors as well as less reliability than the inflatable structure of the present invention as shown in FIG. 14.

In all of the above embodiments of the present invention, the provision of one or more connection members 104 in inflatable and non-inflatable structures or combinations thereof eliminates the prior art methods of cementing and other processes that are time consuming and less reliable, and enables the use of a more cost-effective automated assembly process. The resulting structure is substantially stronger than the prior art structure due to the increased resistance in the shear mode of operation, as well as the elimination of human error in a controlled manufacturing process that was not previously possible with prior art cementing techniques.

Although each of the structures in FIGS. 11, 13 and 14 have been described separately, it will be understood that one or more of such structures or their elements may be combined, using as many connection members 104 as necessary, to join the various parts together. By way of example, a life raft may be constructed of a double tube assembly as shown in FIG. 13 with internal ribs or bulkhead panels as shown in FIG. 14, and a floor connected to one of the tubular members as shown in FIG. 11.

It will be appreciated by those skilled in the art that changes could be made to the embodiments described above without departing from the broad inventive concept thereof. For example, the first and second strip portions can have varying length, width, thickness, weight, and weave type. The first, second and third legs can also vary in length, thickness, number of layers, and so on. Thermobonding can be substituted by any suitable means of securing the strip portions and/or walls together. Moreover, the fabric material and thickness, coating material and thickness, etc., can vary depending on the particular structure to be constructed. The connection members and walls can be formed into any desired shape and size and can be formed into floatation devices, emergency evacuation devices, swimming pools, temporary shelters, or any other device where it is desirable to connect two or more panels together.

It is understood, therefore, that this invention is not limited to the particular embodiments disclosed, but it is intended to cover modifications within the spirit and scope of the present invention as defined by the appended claims.

What is claimed is:

1. A method of forming an inflatable structure in the form of a bulkhead assembly having a tubular member with at least a semi-cylindrical inner surface forming at least first and second compartments separated by a panel interposed therebetween;

a flexible connection member comprising a first flexible leg, a second flexible leg extending from the first leg and a third flexible leg extending from the first and second flexible legs, said method comprising the steps of:

joining the first and second legs to the semi-cylindrical surface of the tubular member and joining the third leg with an outer periphery of the panel, the first and second legs are joined to the inner surface of the tubular member, while the tubular member is flat and before it is inflated so as to form a tubular shape body, whereas the third leg and the panel are joined together after inflation of the tubular member and formation of the semi-cylindrical inner surface, and forming the bulkhead assembly wherein the first and second legs follow the inner surface of the tubular member so as to have a semi-cylindrical configuration, with the third leg extending substantially normally to a longitudinal axis of the tubular member.

2. A method according to claim 1, wherein the third leg and the panel are joined in a continuous operation around the outer periphery of the panel.

3. A method according to claim 1, wherein said step of joining the first and second legs are thermally fused to the inner surface of the tubular member, while the third leg is thermally fused to the outer periphery of the panel.

4. A method according to claim 1, further comprising the steps of:

providing first and second flexible strip portions;

positioning one of the flexible strip portions over the other flexible strip portion; and joining one end section of the first and second flexible strip portions together to thereby form a first flexible leg with second and third flexible legs extending from the first flexible leg;

wherein each of the first and second strip portions comprises a flexible core material and bonding layer on at least one side of the core material, and wherein the joining step comprises heat fusing the bonding layers together at the one end sections of the first and second flexible strip portions.

5. A method according to claim 4, wherein the bonding layers are selected from the group comprising layers of elastomeric and other fusable materials.

* * * * *